US005275426A

United States Patent [19]

Tankersley

[11] Patent Number: 5,275,426

[45] Date of Patent: Jan. 4, 1994

[54] THORACIC SUSPENSION WALKER

[76] Inventor: Cecil A. Tankersley, Rte. 7, Box 229 ½ Greenwood Rd., So. Charleston, W. Va. 25309

[21] Appl. No.: 778,239

[22] Filed: Oct. 17, 1991

[51] Int. Cl.[5] ..... A61H 3/00

[52] U.S. Cl. ..... 280/87.051; 280/87.05; 482/24; 482/69; 135/67

[58] Field of Search ..... 280/87.51, 87.05; 297/5; 482/23, 24, 69, 167; 135/67

[56] References Cited

U.S. PATENT DOCUMENTS

| | | | |
|---|---|---|---|
| 1,611,807 | 12/1926 | Bergh . | |
| 1,642,184 | 9/1927 | Urso . | |
| 2,327,671 | 8/1943 | Rupprecht . | |
| 2,719,568 | 10/1955 | Webb . | |
| 2,812,010 | 11/1957 | Abdallah | 482/69 |
| 3,252,704 | 5/1966 | Wilson . | |
| 3,680,889 | 8/1972 | Bonomo . | |
| 4,111,445 | 9/1978 | Hailbeck . | |
| 4,188,966 | 2/1980 | Palmer et al. . | |
| 4,211,426 | 7/1980 | Motloch . | |
| 4,551,108 | 11/1985 | Bass | 482/69 |
| 4,770,410 | 9/1988 | Brown . | |
| 4,941,497 | 7/1990 | Prather | 135/71 |

FOREIGN PATENT DOCUMENTS

| | | | |
|---|---|---|---|
| 598000 | 12/1925 | France | 297/5 |

*Primary Examiner*—Henry E. Raduazo

*Attorney, Agent, or Firm*—Jacobson, Price, Holman & Stern

[57] ABSTRACT

A walker including a wheeled frame with laterally spaced upright side supports which extend laterally inwardly at their upper ends for detachable and articular connection to opposite sides of a body jacket mounted on and generally in enclosing relation to the thoracic cavity of a user. The jacket is of molded plastic material having a substantial degree of vertical rigidity and an entrance slot enabling the jacket ends to be spread apart to enable it to be placed around the chest or thoracic cavity with straps securing the jacket in place. Opposite side portions of the jacket are provided with headed studs which are received in upwardly facing slots and retained therein by retaining members on the inner ends of the laterally inwardly extending side members of the wheeled frame to provide a pivotal connection between the jacket and the wheeled frame with the entire weight of the user being supported by the jacket and wheeled frame thereby leaving the hands, arms, legs and feet free to move. This enables the user to move from one location to another by exerting foot thrust on a floor surface without the user being required to support their own weight.

13 Claims, 2 Drawing Sheets

FIG. 3
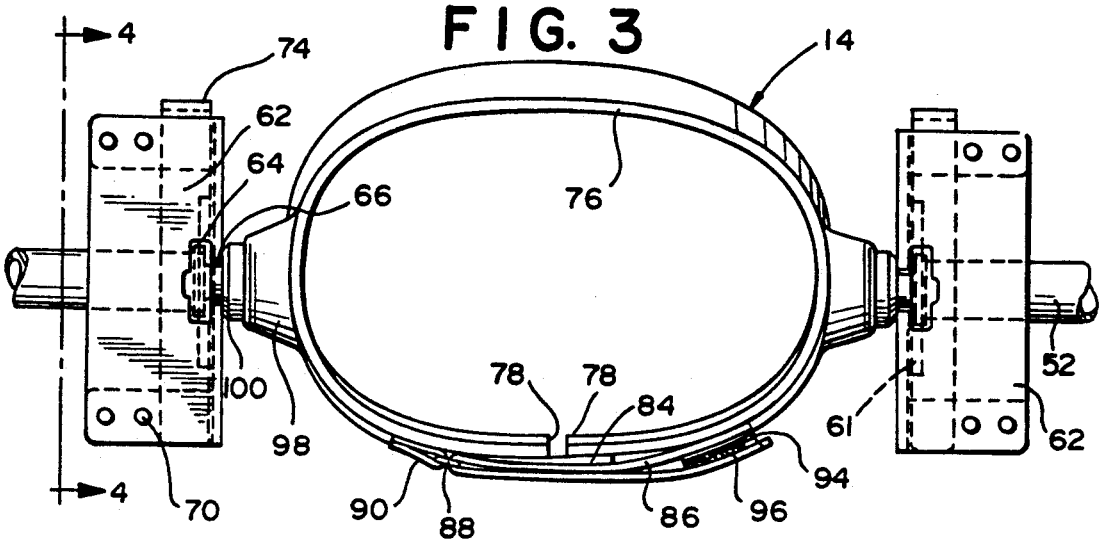
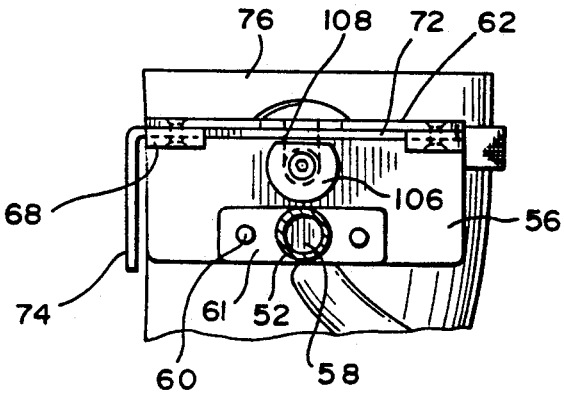
FIG. 4
FIG. 5
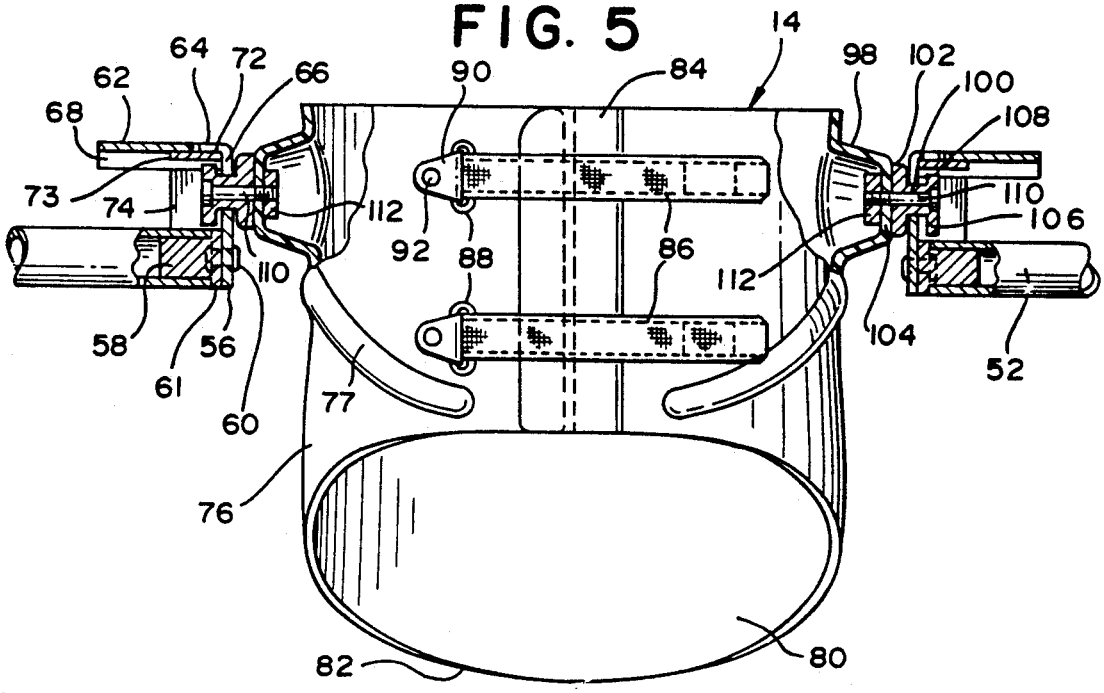

THORACIC SUSPENSION WALKER

BACKGROUND OF THE INVENTION

1. Field of the Invention

The present invention generally relates to a walker which enables a user to move from one location to another without the assistance of another individual or individuals. More specifically, the walker includes a wheeled frame with laterally spaced upright side supports which extend laterally inwardly at their upper ends for detachable and articulate connection to opposite sides of a body jacket mounted on and generally in enclosing relation to the thoracic cavity of a user. The jacket is of molded plastic material having a substantial degree of vertical rigidity and an entrance slot enabling the jacket ends to be spread apart to enable it to be placed around the chest or thoracic cavity with straps securing the jacket in place. Opposite side portions of the jacket are provided with headed studs which are received in upwardly facing slots and retained therein by retaining members on the inner ends of the laterally inwardly extending side members of the wheeled frame to provide a pivotal connection between the jacket and the wheeled frame with the entire weight of the user being supported by the jacket and wheeled frame thereby leaving the hands, arms, legs and feet free to move. This enables the user to move from one location to another by exerting foot thrust on a floor surface without the user being required to support their own weight.

2. Description of the Prior Art

Various types of walkers have been provided in the form of wheeled frames with adjustable structures to support a user or occupant. Such structures involve arrangements which support a patient or occupant of the walker by engaging the armpits or providing a sling type structure or seat. While such devices function for their intended purposes, they have not proven successful in supporting young patients who may not have full control of their torso or upper body and do not provide adequate support for older patients having various ailments which require stable support of the chest or thoracic cavity while leaving the hands and arms as well as the legs and feet of the patient free to move. The following patents disclose developments in this field of endeavor.

1,611,807
1,642,184
2,327,671
2,719,568
3,252,704
3,680,889
4,111,445
4,188,966
4,211,426
4,770,410

While the above patents disclose various walkers with various structure for supporting a patient or occupant from the frame of the walker, the above patents do not disclose a jacket type torso support which grips and supports the waist area and thoracic cavity above the pelvis in which the jacket is substantially rigid and provided with laterally projecting diametrically opposed headed studs for detachable pivotal engagement with a wheeled frame so that patients become ambulatory in a more secure and dependable manner.

SUMMARY OF THE INVENTION

An object of the present invention is to provide a thoracic suspension walker for patients requiring secure and dependable support for the torso area to enable such patients to be ambulatory with the walker including a wheeled frame and a torso encircling and supporting jacket and a unique detachable and pivotal connection between the jacket and the wheeled frame to enable the walker to be easily used in a stable and dependable manner while leaving the arms and hands as well as the legs and feet of the patient completely free of the walker.

Another object of the invention is to provide a thoracic suspension walker in accordance with the preceding object in which the jacket is constructed of a substantially rigid plastic material having sufficient flexibility to enable the normally adjacent ends of the jacket which encircles the chest or thoracic cavity at and above the waist to be spread apart to enable the jacket to be placed on the patient and adjustable straps enabling the jacket then to be securely mounted on the patient with the jacket securely gripping the waist by use of the crest rolls above the pelvis thereby providing stable trunk or torso support.

A further object of the invention is to provide a walker in accordance with the preceding objects in which the sides of the jacket are provided with outwardly extending, rigidly mounted headed studs adjacent the upper edge of the jacket with the headed studs being detachably received in upwardly opening slots in mounting plates provided on the wheeled frame of the walker with retaining members being used to close the slot to securely and pivotally connect the jacket to the wheeled frame and permitting easy separation of the wheeled frame and the jacket and easy assembly of the jacket in the wheeled frame.

Still another object of the invention is to provide a thoracic suspension walker as set forth in the preceding object which is very stable in operation and dependable to enable a patient to be ambulatory with confidence in the stability of the walker with the walker being capable of supporting the entire weight of the patient and suspending the patient in a manner to enable free use of the legs and feet as well as the arms and hands.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a top plan view of the body jacket and associated mounting plates supported at the inner ends of the laterally inwardly extending ends of the side portions of the walker frame.

FIG. 4 is a vertical sectional view taken substantially upon a plane passing along section line 4—4 on FIG. 3 illustrating further structural details of the connection between the body jacket and mounting plate.

FIG. 5 is a front elevational view of the structure of FIG. 3 with portions illustrated in section to show the specific structural details of the connection between the body jacket and walker frame.

DESCRIPTION OF THE PREFERRED EMBODIMENT

Figure 1:
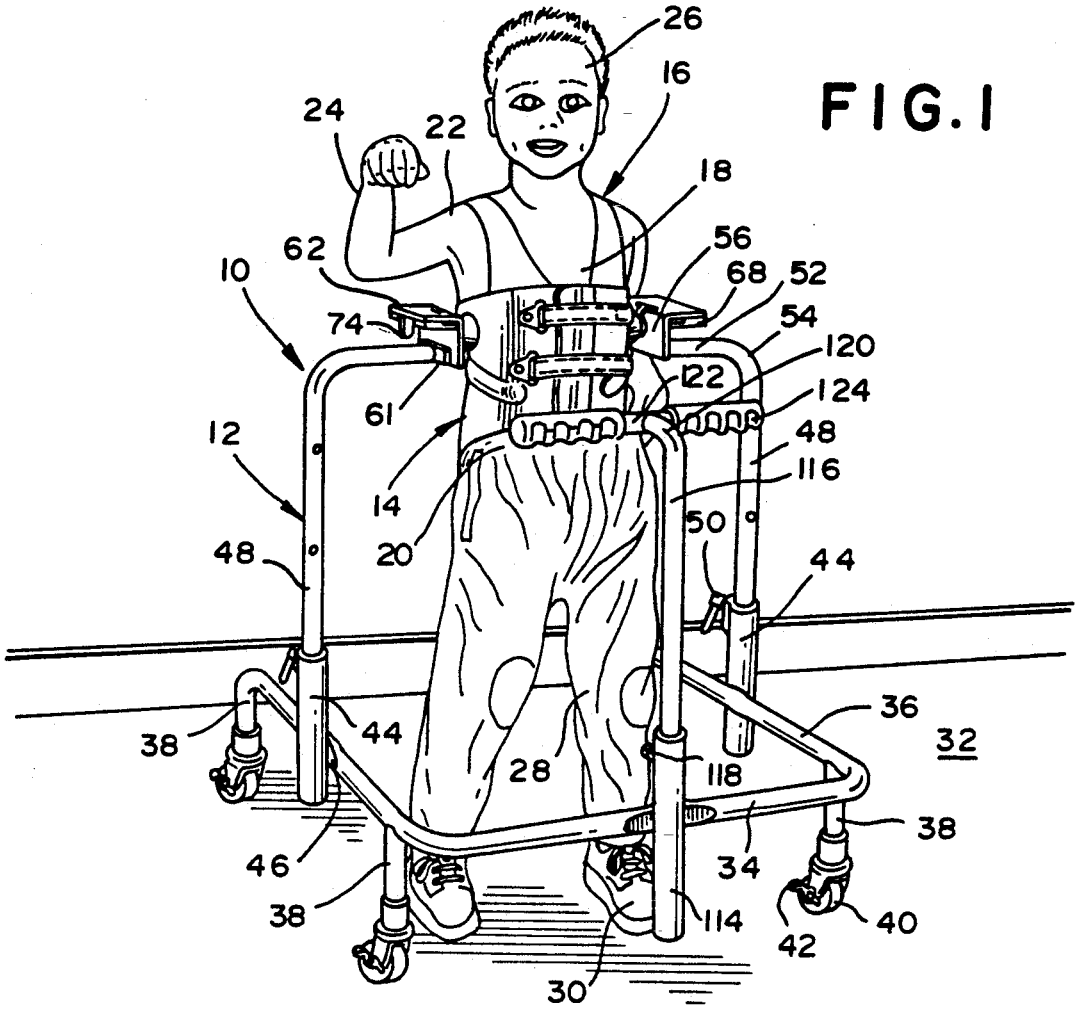
FIG. 1 is a perspective view of the walker of the present invention illustrating the manner of use thereof.

The thoracic suspension walker of the present invention is generally designated by the reference numeral 10 and includes a mobile wheeled frame 12 which supports a body jacket generally designated by reference numeral 14 to effectively support a patient or user 16 by encircling and gripping engagement of the torso, chest cavity or thoracic cavity 18 with the end thereof adjacent the waist area securely gripping the crest rolls immediately above the pelvis as indicated at reference numeral 20. The upper edge of the body jacket 14 terminates below the armpits and shoulders 22 thus leaving the arms 24 and hands free to move and also enabling the head 26 and the legs 28 and feet 30 free to move with the entire weight of the patient 16 being supported by the walker 10 with the feet 30 capable of engaging and exerting thrust on a floor surface 32. This enables the walker 10 to be moved along the supporting floor surface 32 by movement of the legs 28 and feet 30 but yet lets the legs and feet move freely in relation to the walker and also enables the arms and hands as well as the head to move freely in relation to the walker.

The walker frame 12 includes a substantially horizontally disposed U-shaped frame member 34 having parallel legs 36 which extend generally parallel to the floor surface 32 with the U-shaped frame member 34 being supported by a plurality of depending legs 38 with two legs being disposed adjacent to but slightly rearwardly from the bight portion of the U-shaped frame member 34 and the other two legs 38 being located at the rearward ends of the legs 36 thus providing an entrance area at the rear of the U-shaped frame member 34. Each of the legs 38 includes a roller 40 at the lower end thereof which may be a caster wheel or the like and each of the rollers or caster wheels 40 is provided with a manually operated brake 42 to prevent rotational movement of the rollers or caster wheels. The caster wheels 40 and the brakes 42 are of conventional construction and enable the walker 10 to be rolled along the floor surface 32 when the brakes 42 are not applied but will prevent rolling movement of the rollers or caster wheels 40 when the brakes 42 are applied.

Adjacent the central portion of each of the horizontal legs 36, a vertical sleeve 44 is attached by welding or the like with the outer surface of the central portion of the legs 36 being flattened as at 36 to facilitate rigid attachment of the vertical sleeves 44.

Adjustably mounted in each of the vertical sleeves 44 is a vertical side member 48 locked in vertically adjusted position in the tubular sleeve 44 by a set screw structure with a laterally extending handle as designated by reference numeral 50 to enable vertical adjustment of the tubular side member 48. The upper end of each tubular side member 48 is provided with a laterally extending horizontally disposed portion 52 forming a continuation of the member 48 and joined thereto by a right angle bend 54.

The inner end of each laterally inwardly extending upper end portion 52 of each side member 48 is provided with a generally rectangular, vertically disposed mounting plate 56 which is secured to the end of the tubular member 52 by an inserted plug 48 rigidly affixed to the tubular member 52 and a rivet, bolt or other fastener 60 extending through the mounting plate 56 and extending through and securely anchoring a smaller rectangular plate 61 that is integral with the plug 58 thereby rigidly securing the mounting plate 56 to the end of the tubular member 52 forming the laterally inwardly extending upper end of the tubular side member 48 as illustrated in FIGS. 4 and 5.

The upper edge of the mounting plate 56 is provided with a laterally outwardly extending plate 62 in perpendicular relation to the vertical mounting plate 56. The central juncture between the horizontal plate 62 and the vertical mounting plate 56 is provided with a generally rectangular shaped hole or slot 64 having a depending vertical slot 66 formed in the mounting plate 56 with the slot 66 being centrally located with respect to the opening 64 and depending therefrom and in communication therewith. Each end edge of the plate 62 is provided with a small retaining plate 68 secured in place under the end edge of the plate 62 by rivets 70. A retaining bar 72 is slidably engaged with the undersurface of the plate 62 and is retained in position and underlying engagement with the plate 62 by the retaining plates or bars 68 each of which includes a notch 73 in its upper surface which provides a slot to guide and retain the retaining bar 72 in engagement with the undersurface of the plate 62 as illustrated in FIGS. 3–5. One end of the retaining bar 72 is provided with a depending handle 74 by which the retaining bar 72 can be longitudinally slidably manipulated to move from a locking position illustrated in FIGS. 3–5 to a removed position. When the retaining bar 72 is removed, the slot 66 and opening 64 are opened whereas when the retaining bar 72 is in position as illustrated in FIGS. 3–5, the opening 64 and the upper end of the slots 66 is closed.

Figure 2:
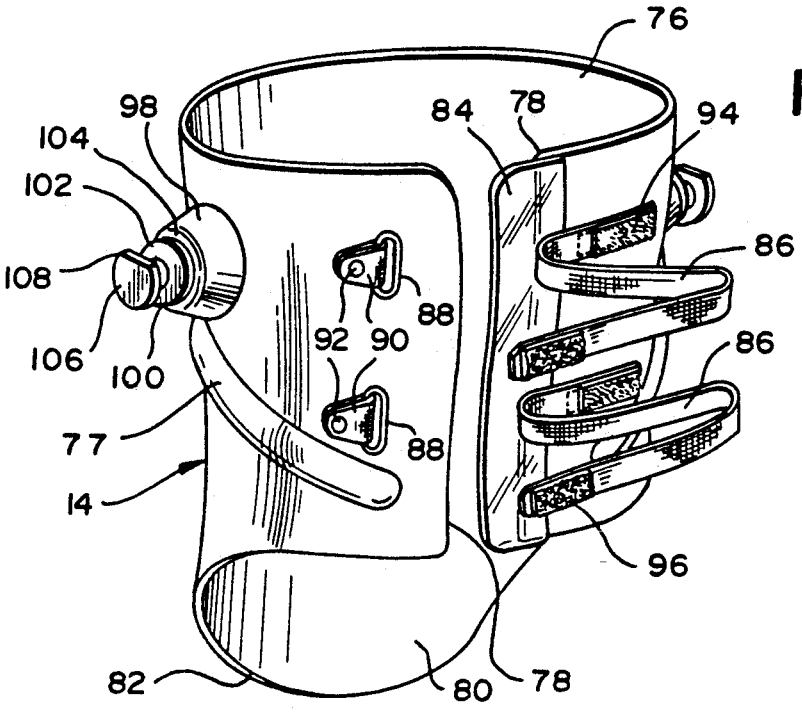
FIG. 2 is a perspective view of the body jacket illustrated in partially open position.

The body jacket 14 is illustrated in greater detail in FIG. 2 as well as in FIGS. 3–5 and includes a one-piece, generally cylindrical torso enclosing member 76 constructed of substantially rigid plastic material which is quite rigid in its vertical dimension but in its circumferential dimension, the generally cylindrical member 76 may be increased in size by moving the vertical edges 78 located at the front of the body jacket in a manner to provide an enlarged entrance slot sufficiently large to enable the body jacket 14 to be placed around the chest and lower torso area 18 of the patient 16 in the manner illustrated in FIG. 1. The rear portion of the generally cylindrical member 76 is provided with a depending extension 80 terminating in a curved lower edge 82 which engages the patient 16 across the buttock and coccyx area thus stabilizing the pelvic, stomach and chest areas of the patient 16 and grippingly engaging the crest rolls at the upper edge portion of the pelvic area. The outer lower rear surface of member 76 may optionally include a reinforcing rib 77 to enhance stability and reduce flexibility of member 76.

One edge 78 of the cylindrical member 76 is provided with a flexible, shape-sustaining flap 84 of plastic or similar material which overlaps the other edge 78 and forms a closure for the slot-like opening formed by the edges 78 of the cylindrical member 76 when the cylindrical member 76 is in gripping engagement with the torso 18 of the patient 16 as illustrated in FIGS. 1, 3 and 5. Attached to the outer edge portion of the cylindrical member 76 adjacent the flap 84 is a pair of vertically spaced flexible straps 86 which extend through D-rings 88 attached to the cylindrical member 76 on the opposite side of the vertical opening defined by the vertical edges 78 by the use of a flexible strap formed into a U-shaped member having tapering top and bottom edges and overlapping end portion secured to the cylindrical member 76 by a fastener rivet 92 or the like. The outer surface of the portion of the strap 86 attached to the cylindrical member 76 is provided with a patch of hook and loop pile fastener material 94, such as "Velcro", and the outer surface of the end portion of the strap 86 is provided with a similar patch of hook and loop fastener material 96 which enables the straps to be threaded through the D-rings 88 and pulled sufficiently tight to securely grip the body jacket 14 around the torso of the patient 16 with the hook and loop pile fastener patches 96 being adjustably connected and engaged with the hook and pile loop fastener patches 94 to secure the body jacket in position on the patient as illustrated in FIG. 1. This enables the body jacket to be used by patients having different dimensional characteristics within the limits defined by the diametrically opposed portions of the cylindrical or oval-shaped member 76.

Each side edge portion of the member 76 is provided with a projection 98 that is integral with the member 76 and is in the form of an outwardly tapering cylindrical member 98 having a stud 100 projecting therefrom with the inner end of the stud including a cylindrical flange 102 engaged with the outer flat surface 104 of the projection 98. The outer end of stud 100 is provided with a head 106 in the form of a generally cylindrical flange which includes a flattened upper edge portion 108 as illustrated in FIGS. 2 and 4. The stud 100 is secured in place by the use of a bolt 110 having a retaining nut 112 on the inner end thereof which engages the inner surface of the outer end 104 of the projection 98.

With this construction, the studs 100 and thus the body jacket can be attached to the frame 12 by removing the retaining bars 72 or at least sliding them to a position to open the opening 64 and slot 66. The headed stud 100 can then be dropped vertically with the flange or head 106 passing through the opening 64 and the stud 100 entering and dropping downwardly into the bottom of the slot 66 which is rounded to pivotally mount and support the headed stud 100 in relation to the mounting plate 56. The retaining bar 72 is then moved to the closed position illustrated in FIG. 4 with the flattened edge 108 of the flange 106 facing upwardly and being disposed adjacent but spaced from the lower surface of the retaining bar 102 thus limiting the pivotal movement of the body jacket 14 in relation to frame 12 thus further stabilizing the patient 16 by limiting the forward and rearward tilting movement of the chest cavity or torso 18.

To further enhance the stability of the patient and enable the patient to become ambulatory and move the walker along the surface 32, the front central portion of the U-shaped frame 34 is provided with a vertically mounted tubular sleeve 114 secured to the U-shape frame 34 in the same manner as the sleeves 44 and which includes a front vertically extending tubular member 116 telescopically received therein and adjustably locked in position by a set screw and handle assembly 118. The upper end of the front central member 116 is provided with a rear-turned upper end 120 disposed generally at the waist region 20 of the patient 16 with the rearward end of the rearwardly extending member 120 terminating in a transverse tubular member 122 extending horizontally to both sides of the member 120 with each end of the member 122 having a handgrip 124 of plastic or other material mounted thereon with the handgrip being of conventional construction and enabling the patient 16 to place the hands on the handgrips and lean forwardly and exert force by using the feet 30 against the floor surface 32 and thus move the walker 10 in a desired direction.

In use, the body jacket 14 is placed on the patient and fastened in the front with the body jacket gripping the waist by use of the crest rolls above the pelvis and providing effective torso or trunk support and providing a very stable support for the torso area. The projecting studs 100 are fitted into and locked into the openings 64 and slots 66 by the use of the retaining bars 72 thereby supporting the entire weight of the patient entirely by the jacket and the walker frame. This enables the patient to stand and walk for an extended time period and provides total freedom of the hands and arms for whatever use desired and eliminates a feeling of confinement and restriction that occurs when using walkers which support the patient under the armpits or support the patient with a seat or sling which extend between the legs. The attachment studs and retaining bars combined with the structure of the body jacket allows freedom of hip movement in that flexion and extension may be adjusted from a position of being fixed or entirely free or at any degree deemed necessary by the physician by varying the flatness 108 on the headed stud. If no flat area 108 is provided, the pivotal attachment is completely free to pivot whereas by providing a flat edge 108 which is in contact with the retaining when in its locked position, pivotal movement will be completely precluded. Thus, by shaping and varying the configuration of a flattened surface 108 by using a file or other instrument, the pivotal characteristics of the body jacket can be easily adjusted depending upon the requirements of the patient. By using the thoracic suspension walker of this invention, the quality of life for patients, especially young patients, will be materially enhanced and enables patients to overcome ambulatory difficulties caused by various conditions. The frame components are preferably constructed of tubular metallic components whereas the body jacket is preferably constructed of plastic material except for the headed stud and bolts although it could be constructed of a metallic material having sufficient rigidity and flexibility to function in the manner as described above.

In order to provide the user of the walker with a generally horizontal surface on which to place food when eating, place toys when playing or following various physical therapy regimens, a tray attachment may be provided at the same elevation as the handlebars. The handlebars are removed by removing member 116 from sleeve 114 thus providing an area directly in front of the user in which to place a generally U-shaped tray with a raised peripheral edge similar to the trays used on high chairs, wheelchairs and the like. To support the tray, it is provided with a pair of downwardly offset, rearwardly extending tubes mounted from and below the tray in parallel relation thereto. A pair of horizontal sleeves with set screws rigidly affixed to the frame members 52 will telescopically receive the tubes on the tray thus detachably mounting the tray in horizontal position and providing a surface on which items may be supported for easy access. This enables the user to eat, play with toys, write, color pictures or practice physical therapy regimens while being supported by the walker.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A walker comprising a mobile frame having a pair of laterally spaced, upwardly extending side members, support means at the upper end of each of said side members, a body jacket enclosing and supportingly engaging the torso of a user, and co-acting connecting means between said body jacket and said support means at the upper end of each side member, said co-acting means including a separable connecting means to support the body jacket from the frame in a manner to support the weight of the user from the frame while leaving the arms and hands free and enabling the legs and feet to be used to exert thrust on a supporting surface to move the mobile frame along the supporting surface, said support means on the upper end of each of said side members including a generally vertically disposed mounting plate, said separable connecting means including said mounting plate having a vertically opening slot formed therein, said body jacket including a pair of laterally outwardly extending headed studs oriented in opposed relation on the body jacket with the headed studs being vertically received in said slots to support the body jacket from the frame.

2. The walker as defined in claim 1 further comprising means locking each headed study in a slot, said locking means including a movable member mounted on said plate to form a closure for the upper end of the slot to retain the headed stud in the slot.

3. The walker as defined in claim 2 wherein said frame includes a generally horizontally disposed U-shaped bottom frame member having a front bight portion and a pair of parallel, spaced leg portions, depending legs on said bottom frame member with rotatable wheel means at the lower ends thereof for enabling the frame to be moved along a supporting surface.

4. The walker as defined in claim 3 wherein a front vertical member is attached to said bight portion of the bottom frame member and extends upwardly in front of a user, a transversely extending bar with handgrips at the end of the front member to provide handles to enable a user to operate and control the walker.

5. The walker as defined in claim 2 wherein each headed stud includes a flange on the inner end thereof in perpendicular relation to the stud, said flange having a flat edge portion oriented upwardly for engaging said locking means to limit pivotal movement of the body jacket in relation to the mobile frame.

6. The walker as defined in claim 1 wherein said body jacket is a generally oval-shaped, vertically elongated member constructed with substantial vertical rigidity, a front portion of the jacket having a vertical opening enabling the jacket to be opened for enclosing the thoracic cavity of a user, and strap means securing the edges of the opening in adjusted relation to enable the body jacket to securely grip the thoracic cavity of a patient.

7. The walker as defined in claim 6 wherein said body jacket includes an upper edge terminating adjacent to but below the arm pits of a user, said body jacket including a lower end portion having a rearward portion which engages a buttock area of a patient with the lower end portion grippingly engaging crest rolls at the upper portion of the pelvic area of a patient to maintain the thoracic cavity of a user generally in an upright stabilized position while leaving the arms and hands free for movement in any direction.

8. A walker comprising a generally u-shaped, horizontally disposed frame member having wheel means mounted thereon at spaced intervals to support the frame member from a supporting surface for movement in relation to the supporting surface, said frame member including opposite side portions, an upwardly extending side member rigidly connected to each side portion of said frame, the upper ends of said side members extending laterally inwardly, a substantially rigid, vertically elongated body jacket of generally oval shaped transverse configuration conforming with and grippingly engaging the periphery of the thoracic cavity of a user and grippingly engaging a major portion of the thoracic cavity between the pelvic area and arm pit area to stabilize the thoracic cavity and enable the body jacket to support the thoracic cavity and means connecting said body jacket at opposite side portions thereof to the inwardly extending upper ends of said side members thereby supporting the weight of the user from the frame while leaving the arms and hands free and enabling the legs and feet to be used to exert thrust on a supporting surface to move the walker along the supporting surface, said means connecting the body jacket to the inwardly extending upper ends of the side members including a detachable connection, said detachable connection including lock means to securely retain the detachable connection in connected relation, said detachable connection including a headed stud extending outwardly from opposite side portions of said body jacket and being rigid therewith, a mounting plate on an inner end of the inwardly extending upper end of each side member, each mounting plate including vertical slot means receiving a headed stud with the vertical slot means and headed studs enabling pivotal movement of the body jacket about an axis transverse of the body jacket and thoracic cavity of a user.

9. The walker as defined in claim 8 wherein each headed stud is provided with means associated with said mounting plate to limit the pivotal movement of said headed studs and body jacket in relation to the inner ends of the inwardly extending ends of the side members to maintain the body jacket and thoracic cavity of the user in a generally vertical orientation and permitting limited pivotal movement about a transverse axis.

10. The walker as defined in claim 9 wherein said lock means includes a slide plate forming a closure for the slot means to retain the headed stud in the slot means, said side members being vertically adjustable to enable the walker to be used with users having different height characteristics and vary the contact characteristics between the feet of the user and a supporting surface for the walker.

11. The walker as defined in claim 8 wherein said body jacket is of one piece construction and constructed with substantial vertical rigidity, said body jacket including a front portion having a vertical opening enabling the jacket to be opened for enclosing the thoracic cavity of user and strap means securing the edges of the opening in adjusted relation to enable the body jacket to grippingly engage the thoracic cavity of a user from the crest rolls above the pelvic area to an area immediately below the arm pits.

12. A walker comprising a generally u-shaped, horizontally disposed frame member having wheel means mounted thereon at spaced intervals to support the frame member from a supporting surface for movement in relation to the supporting surface, said frame member including opposite side portions, an upwardly extending side member rigidly connected to each side portion of said frame, the upper ends of said side members extending laterally inwardly, a substantially rigid, vertically elongated body jacket of generally oval shaped transverse configuration conforming with and grippingly engaging the periphery of the thoracic cavity of a user and grippingly engaging a major portion of the thoracic cavity between the pelvic area and arm pit area to stabilize the thoracic cavity and enable the body jacket to support the thoracic cavity and articulate laterally stable means connecting said body jacket at opposite side portions thereof to the inwardly extending upper ends of said side members thereby supporting the weight of the user from the frame while leaving the arms and hands free and enabling the legs and feet to be used to exert thrust on a supporting surface to move the walker along the supporting surface.

13. The walker as defined in claim 12 wherein said means connecting the body jacket to the inwardly extending upper ends of the side members including a detachable connection, said detachable connection including lock means to securely retain the detachable connection in connected relation.

* * * * *